US006058866A

United States Patent [19]

May

[11] Patent Number: 6,058,866

[45] Date of Patent: May 9, 2000

[54] DECK ASSEMBLY FOR A BOAT

[76] Inventor: Lindy Lawrence May, P.O. Box 399, Strafford, Mo. 65757

[21] Appl. No.: 08/936,177

[22] Filed: Sep. 24, 1997

Related U.S. Application Data

[63] Continuation-in-part of application No. 08/824,821, Mar. 26, 1997, abandoned.

[51] Int. Cl.[7] ..... B63B 3/48

[52] U.S. Cl. ..... 114/85; 114/364

[58] Field of Search ..... 114/85, 343, 362, 114/364, 61, 61.1; 414/537; 14/69.5, 71.1, 71.7

[56] References Cited

U.S. PATENT DOCUMENTS

| | | | |
|---|---|---|---|
| 2,669,733 | 2/1954 | Picker | 114/362 |
| 3,052,896 | 9/1962 | Beach | 114/362 |
| 3,155,258 | 11/1964 | Fincannon | 414/537 |
| 3,229,833 | 1/1966 | Heck et al. | 414/537 |
| 3,511,393 | 5/1970 | Abromavage et al. | 414/537 |
| 3,613,137 | 10/1971 | Eccles . | |
| 3,792,502 | 2/1974 | Odegaard | 114/61 |
| 3,925,837 | 12/1975 | Miller | 114/61 |
| 4,085,473 | 4/1978 | Franklin . | |
| 4,293,967 | 10/1981 | Ord | 114/362 |
| 4,354,447 | 10/1982 | Hultgren | 114/343 |
| 4,624,619 | 11/1986 | Uher | 414/537 |
| 4,971,315 | 11/1990 | Rector | 114/61 |
| 4,993,341 | 2/1991 | Merkel | 114/362 |
| 5,085,165 | 2/1992 | Reed | 114/362 |
| 5,123,372 | 6/1992 | Kobayashi et al. | 114/362 |
| 5,136,963 | 8/1992 | Zuzik . | |
| 5,170,741 | 12/1992 | Magers et al. . | |
| 5,542,370 | 8/1996 | Castleberry . | |

FOREIGN PATENT DOCUMENTS

| | | | |
|---|---|---|---|
| 61-271191 | 12/1986 | Japan | 114/343 |
| 61-271195 | 12/1986 | Japan | 114/343 |

*Primary Examiner*—Sherman Basinger
*Attorney, Agent, or Firm*—Polster, Lieder, Woodruff & Lucchesi, L.C.

[57] ABSTRACT

An extendable deck assembly for a boat to provide additional use area of the boat while on the lake. In the retracted position the extendable deck permits a smaller trailer to be used for transporting the boat and provide better maneuverability on the lake. The extendable deck provides use area in the retracted position as well as the extended position, thereby eliminating stowing problems. The longitudinal movement of the extendable deck may be adapted with an actuating device or may be operated manually. The extendable deck assembly is designed to accommodate the side curvature of the boat and may be a built-in feature of the boat or may be marketed independently.

26 Claims, 15 Drawing Sheets

DECK ASSEMBLY FOR A BOAT

CROSS-REFERENCE

Reference No. 1

Prior application Ser. No.: 08/824,821, now abandoned

Prior application filing date: Mar. 26, 1997

Prior application title: Extendable Deck for a Boat

Prior application relationship: The extendable deck portion disclosed in the prior application is also an integral part of this application This is a continuation-in-part of Ser. No. 08/824,821 filed Mar. 26, 1997 and now abandoned.

FIELD OF THE INVENTION

The present invention relates to the field of boats and more particularly to fishing and recreational boats.

BACKGROUND AND SUMMARY OF THE INVENTION

The general use area of a conventional fishing or recreational boat is restricted to the area within the perimeter of the boat. It is often desired to have additional use area within the boat after the boat has reached its destination on the lake. Larger boats are more costly and require longer, more costly trailers to haul them. Larger boats are also more difficult to maneuver in the parking lot as well as in the lake. Portable or hinged deck extensions provide minimal use area, are cumbersome to use, and create problems to stow when they are not in use or when the boat is being transported.

It is thus a principal object of the present invention to provide an extendable deck assembly for a boat; thereby providing additional use area while the boat is on the lake.

Another object of this invention is to provide an extendable deck assembly for a boat having a longitudinal axis extending from a bow of the boat to a stern of the boat, in which the extendable deck is easily extended and retracted in a longitudinal manner.

A still further object of this invention is to provide an extendable deck assembly for a boat in which the longitudinal movement of the extendable deck is provided by an actuating device.

Another object of this invention is to provide an extendable deck assembly for a boat in which the extendable deck provides general use area in the retracted position as well as in the extended position, thereby eliminating stowing problems.

It is yet another object of this invention to provide an extendable deck assembly for a boat in which the extendable deck accommodates the side curvature of the boat.

It is still another object of this invention to provide an extendable deck assembly for a boat in which the extendable deck compensates for any tilting of the boat when the extendable deck is in the extended position, thereby providing a more level floor surface in the extended position.

It is yet another object of this invention to provide an extendable deck assembly for a boat which is a built-in feature of the boat.

It is still another object of this invention is to provide an extendable deck assembly for a boat which is adapted with mounting brackets so as to permit the assembly to be marketed separately and installed by the consumer on existing boats.

These and other objects will become apparent hereinafter.

DESCRIPTION OF THE PREFERRED EMBODIMENTS

Figure 1:
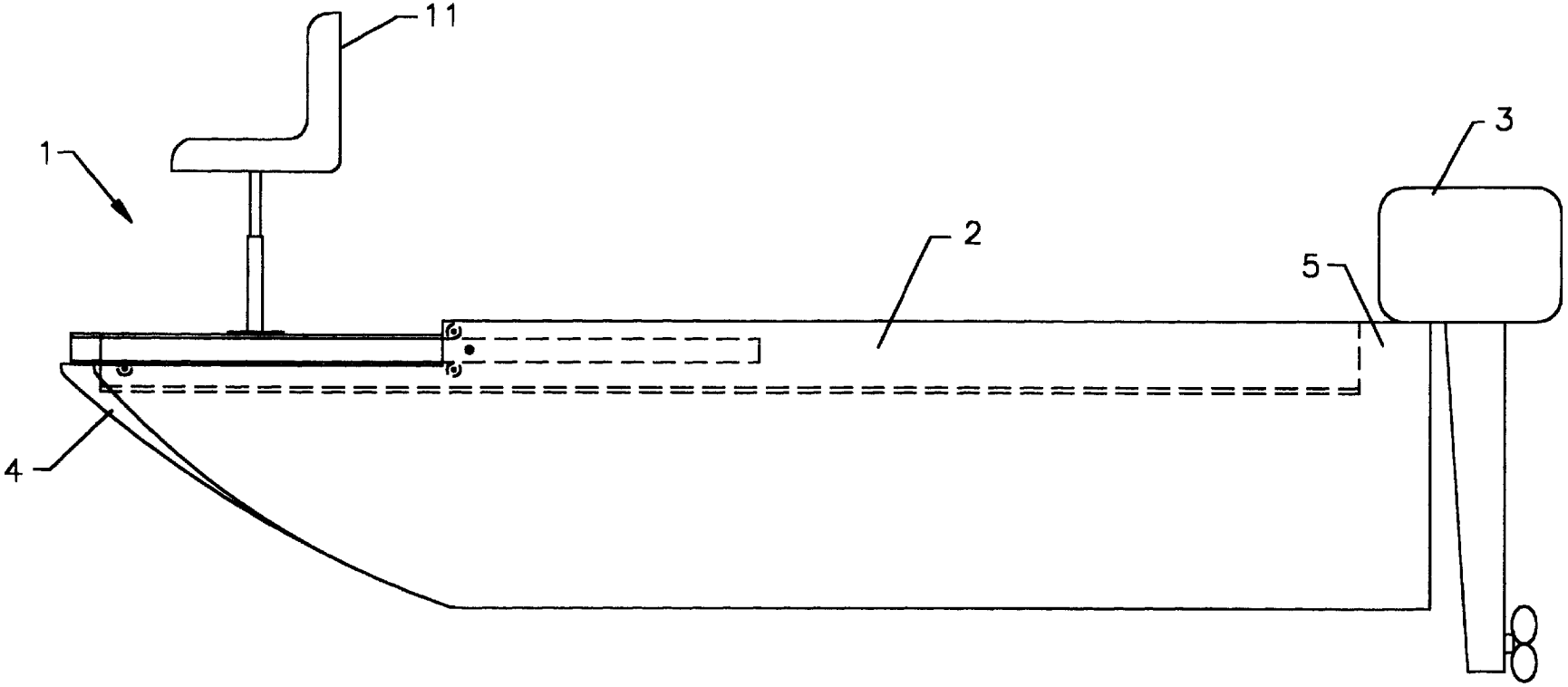
FIG. 1 is a side elevation view of a boat adapted with an extendable deck assembly shown with the deck in the retracted position.

Referring to FIG. 1, there is provided an extendable deck assembly 1 mounted to the bow end 4 of a boat 2, which is the object of the present invention. The aft or stern end 5 of the boat 2 is adapted with an outboard motor 3. A longitudinal axis of the boat extends from the bow of the boat to the stern of the boat. The extendable deck assembly 1 is shown as a built-in feature of the boat 2 and is illustrated in the retracted position.

Figure 2:
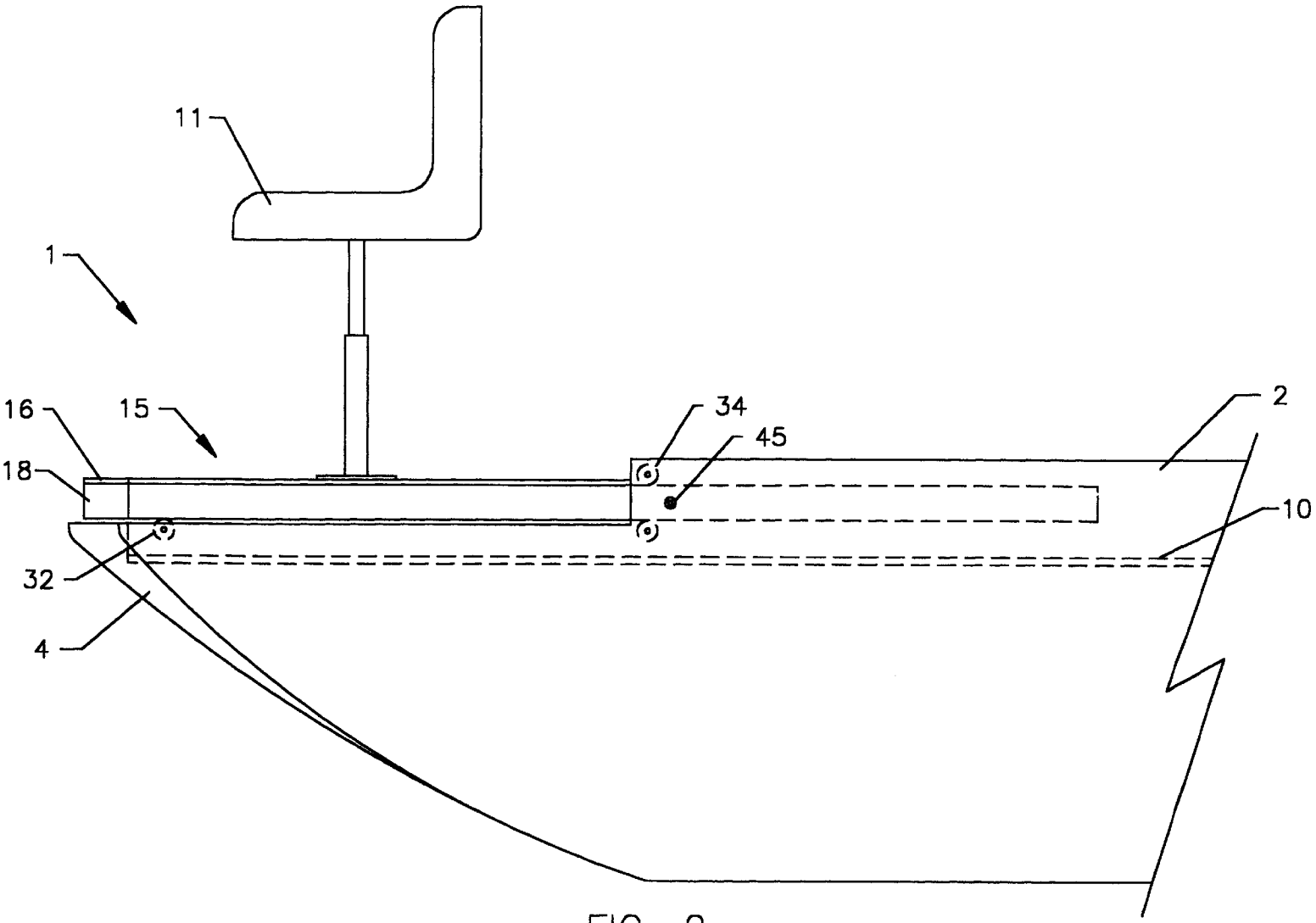
FIG. 2 is an enlarged side elevation view of the extendable deck assembly of FIG. 1.
Figure 3:
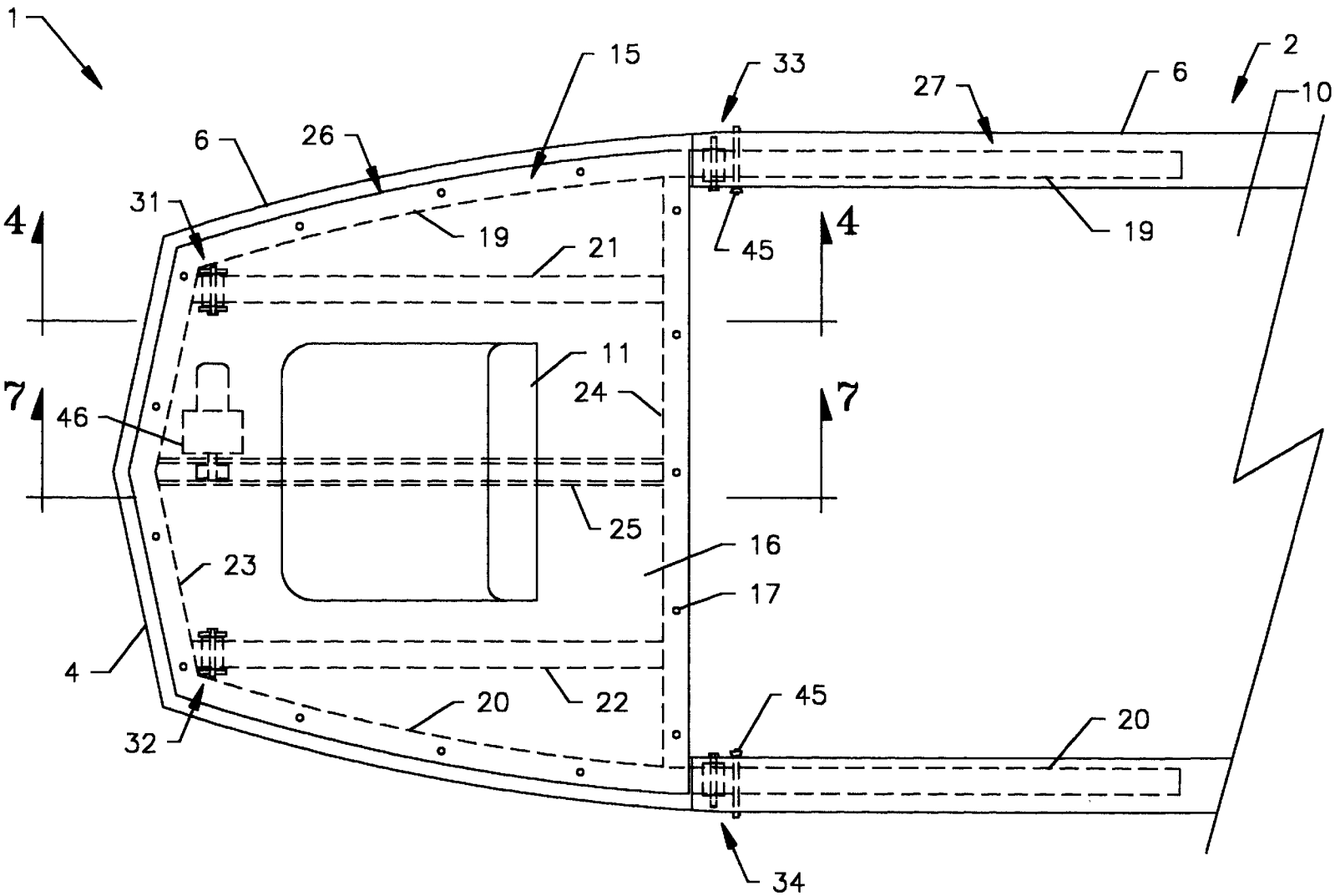
FIG. 3 is a plan view of FIG. 2 with the extendable deck shown in the retracted position.

Referring to FIGS. 2 through 7, the extendable deck assembly 1 is more clearly detailed. The extendable deck assembly 1 is comprised of six primary components which are the extendable deck 15, the two front guide roller assemblies 31, 32, the two back guide roller assemblies 33, 34, and the gearmotor assembly 46, as seen in FIG. 3.

The extendable deck 15 is comprised of a deck platform 16 secured to a frame structure 18, as seen in FIG. 2. The frame structure 18 is constructed with structural channel which may be aluminum, fiberglass, or any durable material. The frame structure 18 is comprised of two outer guide rails 19, 20, two inner guide rails 21, 22, a front deck support member 23, a back deck support member 24, and a center deck support member 25, as seen in FIG. 3. The front portion 26 of each outer guide rail 19, 20 is formed to match the curvature of the boat sidewall 6 with the back portion 27 of each outer guide rail 19, 20 remaining straight and parallel to each other. The deck platform 16 is constructed from marine-grade plywood and is secured to the frame structure 18 with sheet metal screws 17. The deck platform 16 may be provided with various coverings including paint or carpeting. The extendable deck 15 is illustrated equipped with a pedestal seat 11 to illustrate one use of the extendable deck assembly 1 for purposes of this disclosure and it is not intended to imply that the extendable deck assembly 1 is limited to this use as the extendable deck 15 may be outfitted with various other boating accessories such as a trolling motor, lights, railing, bench seats, etc.

The front guide roller assemblies 31, 32 and the back guide roller assemblies 33, 34 provide the means to guide the extendable deck 15 to the extended position and back to the retracted position in a longitudinal manner. The front guide roller assemblies 31, 32 interface with the inner guide rails 21, 22 and the back guide roller assemblies 33, 34 interface with the outer guide rails 19, 20 of the extendable deck 15, as seen in FIG. 3. This offset design of the front guide roller assemblies 31, 32 relative to the back guide roller assemblies 33, 34 permits the extendable deck 15 to match the curvature of the boat sidewall 6.

Figure 4:
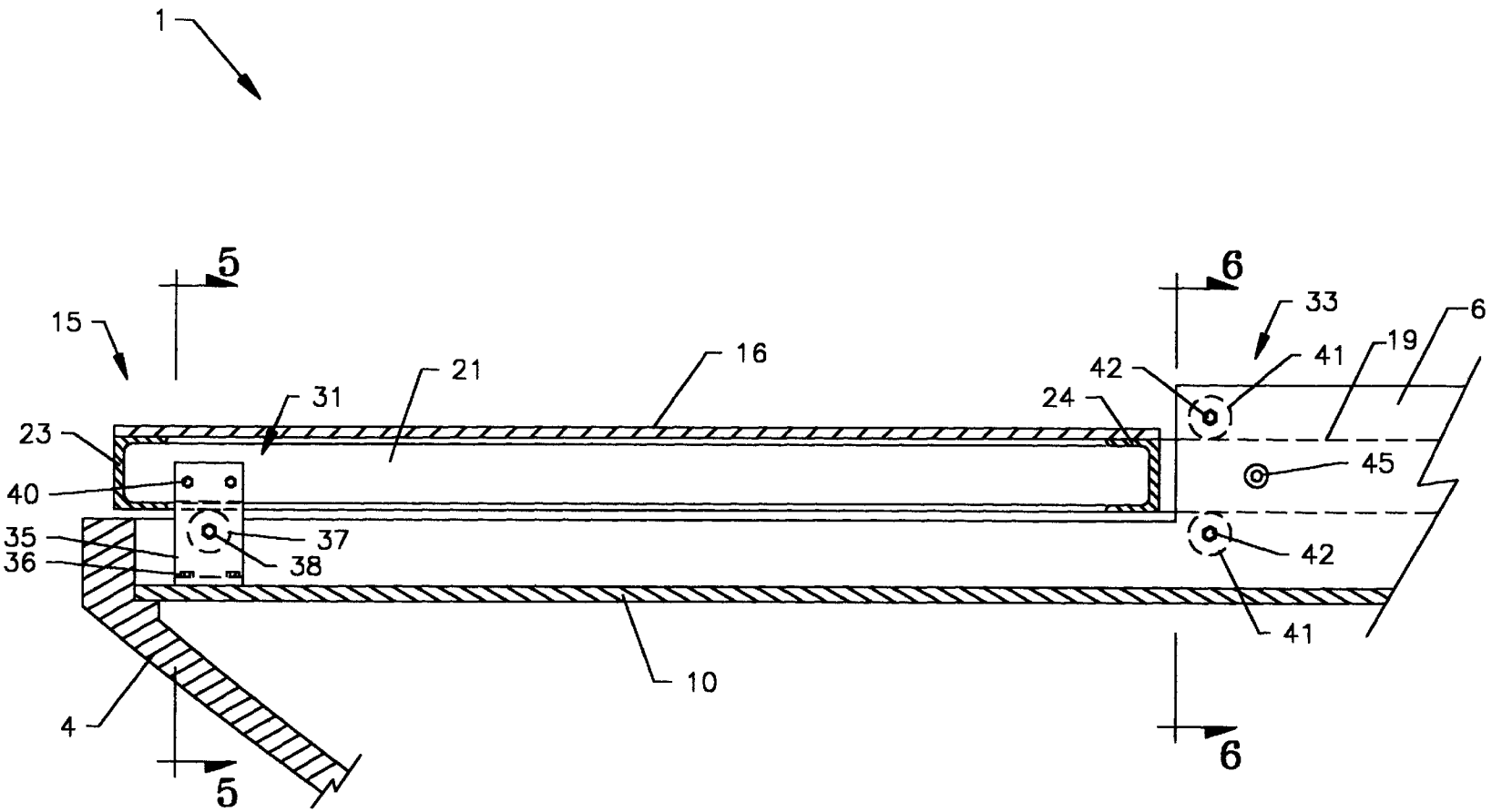
FIG. 4 is a horizontal section view taken along line 4—4 of FIG. 3.
Figure 5:
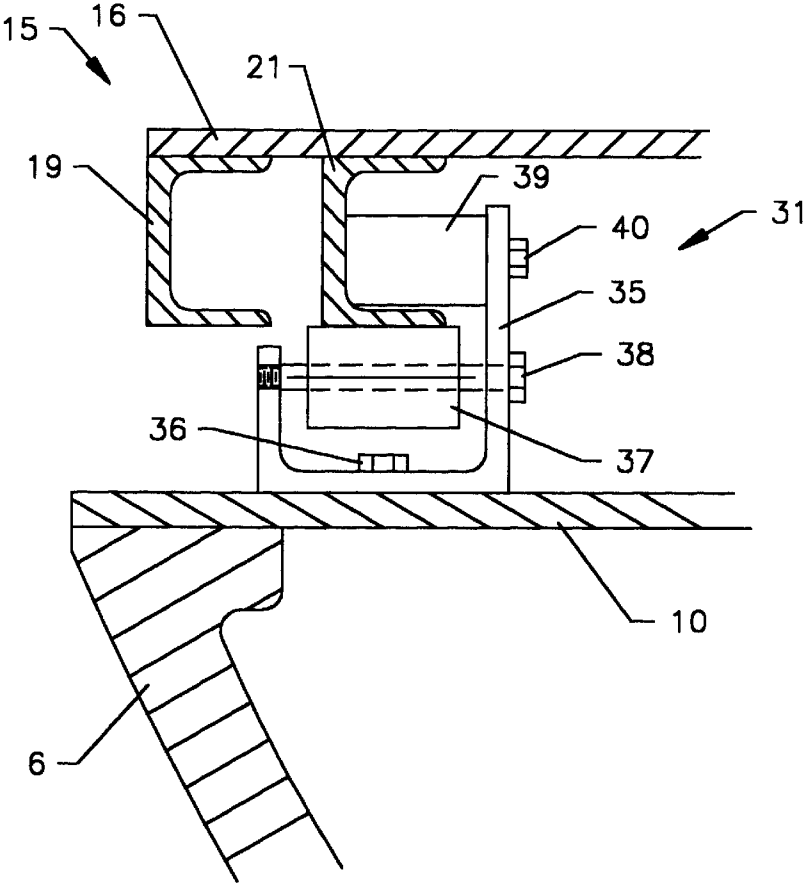
FIG. 5 is a vertical section view taken along line 5—5 of FIG. 4.

Each front guide roller assembly 31, 32 is comprised of a guide roller bracket 35, a guide roller 37, and a guide block 39 as seen in FIGS. 4 and 5 which illustrate the right front guide roller assembly 31. The guide roller bracket 35 is constructed of sheet metal and is secured to the stationary deck 10 of the boat 2 with mounting bolts 36, as shown. The guide roller 37 is constructed of delrin or similar material and is rotatably mounted to the guide roller bracket 35 by means of a shoulder bolt 38. The guide roller 37 supports the inner guide rail 21 and facilitates the longitudinal movement of the extendable deck 15. The guide block 39 is also constructed of delrin or similar material and is secured to the guide roller bracket 35 by means of two mounting bolts 40. The guide block 39 prevents the inner guide rail 21 from sideward movement in the direction of the guide block 39. The guide block 39 also prevents upward movement of the inner guide rail 21 relative to the guide roller 37. The left front guide roller assembly 32 is constructed in the same manner as the right front guide roller assembly 31 and interfaces with the left inner guide rail 22. The guide blocks 39 of the right front guide roller assembly 31 and the left front guide roller assembly 32 work in unison to prevent sideward movement of the extendable deck 15 to the right or to the left relative to the front guide roller assemblies 31, 32.

Figure 6:
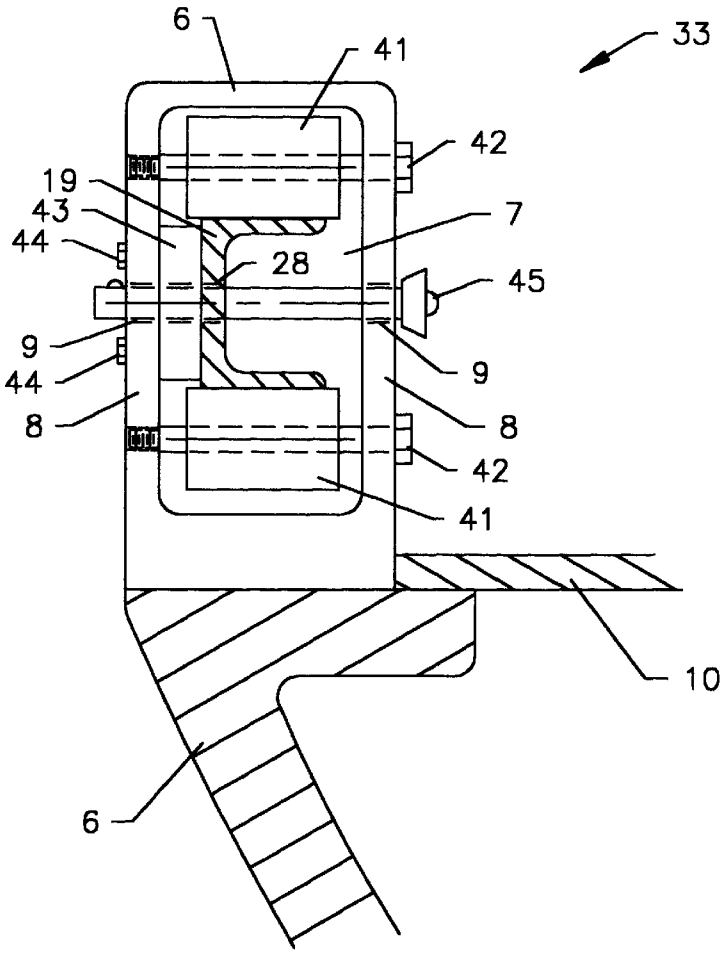
FIG. 6 is a vertical section view taken along line 6—6 of FIG. 4.

The back guide roller assemblies 33, 34 are built-in to the sidewalls 6 of the boat 2. A cavity 7 in each sidewall 6 provides a housing for the back guide roller assemblies 33, 34. Each back guide roller assembly 33, 34 provides two guide rollers 41 as seen in FIGS. 4 and 6 which illustrate the right back guide roller assembly 33. The guide rollers 41 are constructed of delrin or similar material and are rotatably mounted in the boat sidewall cavity 7 by means of a shoulder bolt 42. The guide rollers 41 provide support for the outer guide rail 19 and facilitate the longitudinal movement of the extendable deck 15. Each back guide roller assembly 33, 34 also provides a guide block 43. The guide block 43 is constructed of delrin or similar material and is secured in the boat sidewall cavity 7 by means of two mounting bolts 44. The guide block 43 prevents the outer guide rail 19 from sideward movement in the direction of the guide block 43. The left back guide roller assembly 34 is constructed in the same manner as the right back guide roller assembly 33 and interfaces with the left outer guide rail 20. The guide blocks 43 of the right back guide roller assembly 33 and the left back guide roller assembly 34 work in unison to prevent sideward movement of the extendable deck 15 to the right or to the left relative to the back guide roller assemblies 33, 34. Each boat sidewall cavity 7 is provided with a hole 9 through each side 8 to interface with the quick pins 45, as seen in FIG. 6. The back portion 27 of each outer guide rail 19, 20 is adapted with two holes 28 to interface with the quick pins 45. The quick pins 45 are used to retain the extendable deck 15 in the extended and retracted positions as they interface with the appropriate hole 28 in the outer guide rails 19, 20 and the holes 9 in the boat sidewall cavities 7.

Figure 7:
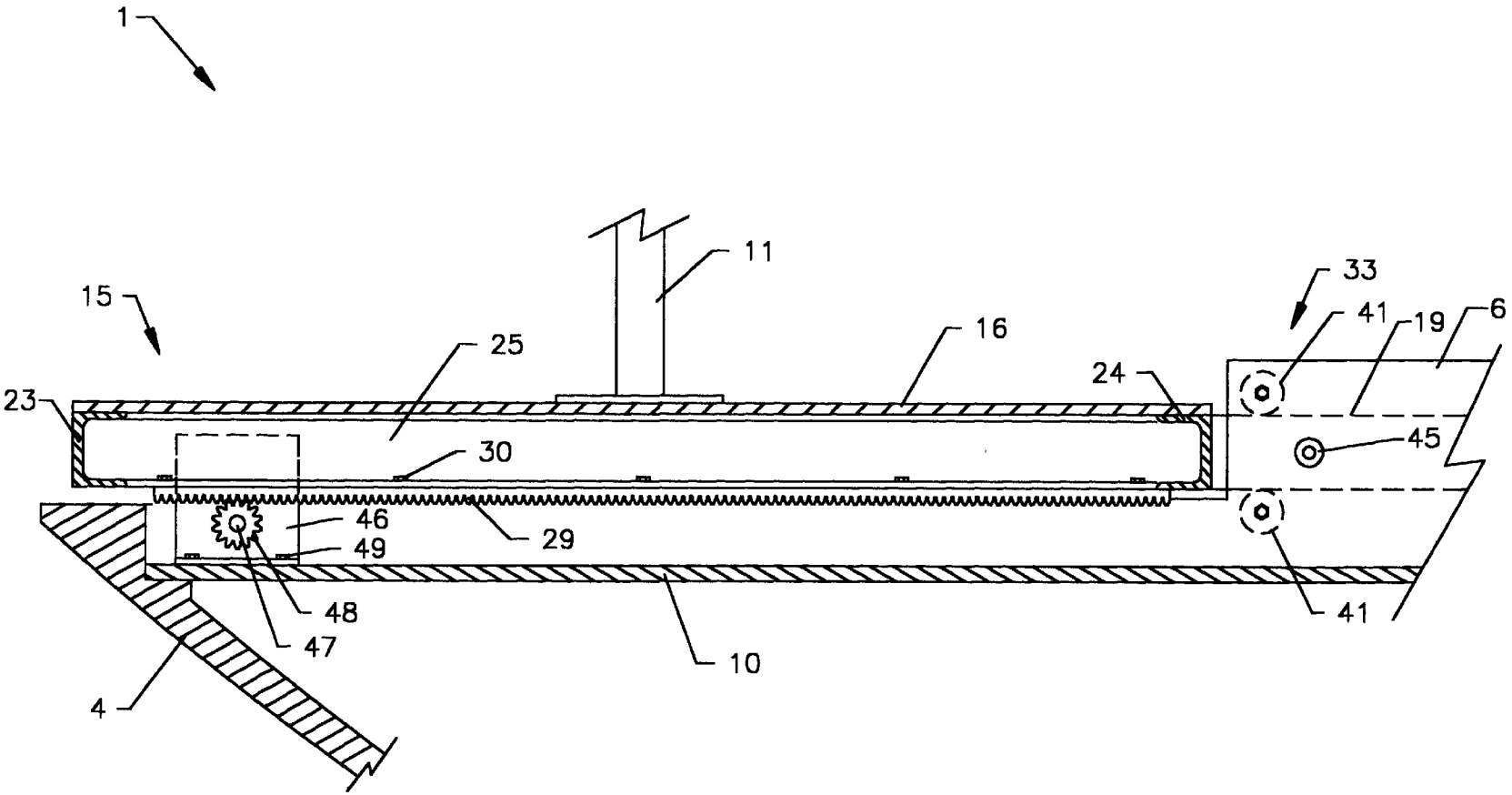
FIG. 7 is a horizontal section view taken along line 7—7 of FIG. 3.

The longitudinal movement of the extendable deck assembly 1 may be facilitated with an actuating device. A 12-volt D.C. gearmotor 46 is mounted to the stationary deck 10 by means of mounting bolts 49, as seen in FIGS. 3 and 7. A gear rack 29 is mounted under the center deck support member 25 by means of mounting bolts 30, as seen in FIG. 7. The output shaft 47 of the gearmotor 46 is adapted with a pinion gear 48. The pinion gear 48 interfaces with the gear rack 29.

Figure 8:
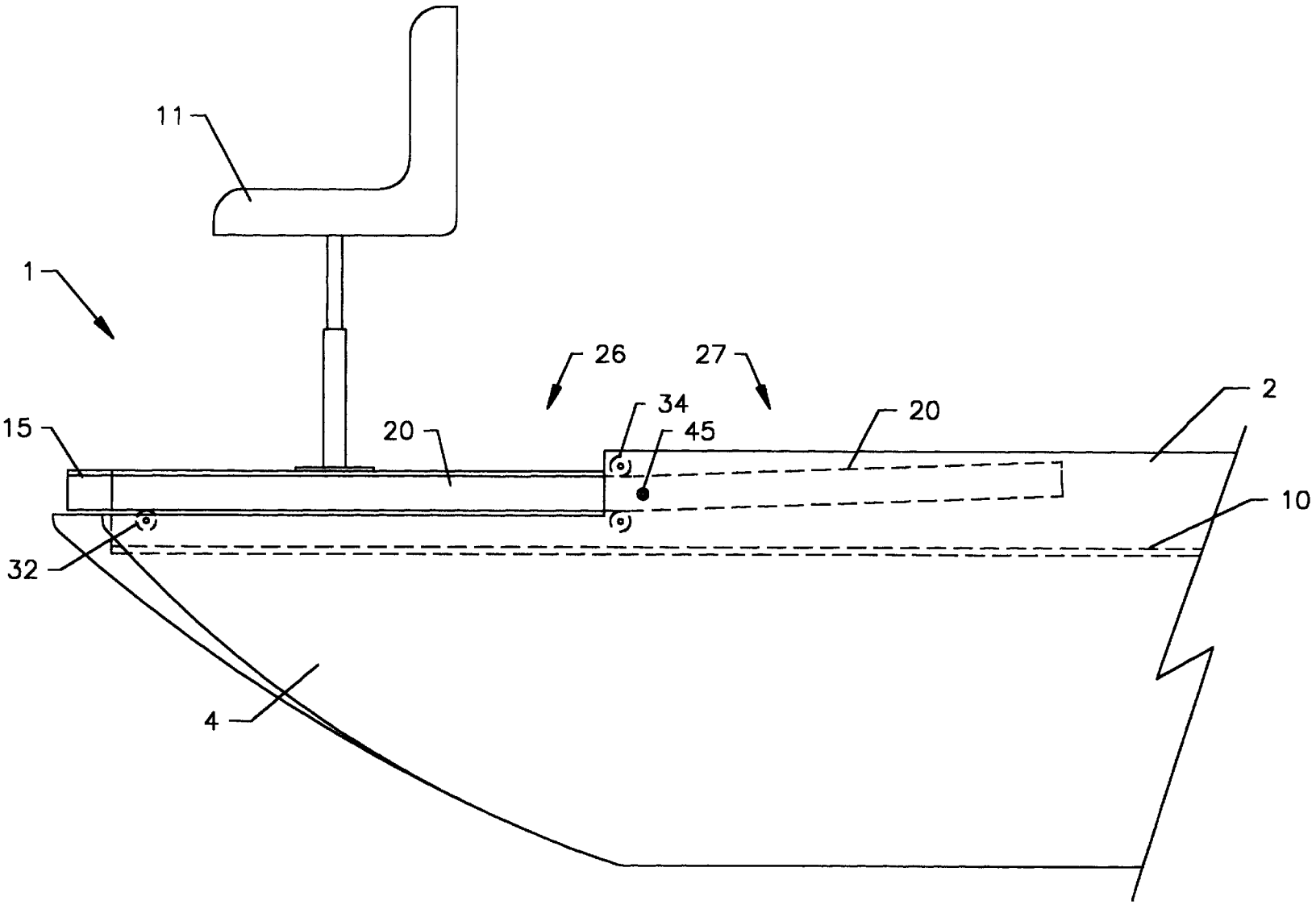
FIG. 8 is a side elevation view of a boat adapted with an extendable deck assembly in which the outer guide rails are slanted slightly upward, shown with the deck in the retracted position.
Figure 9:
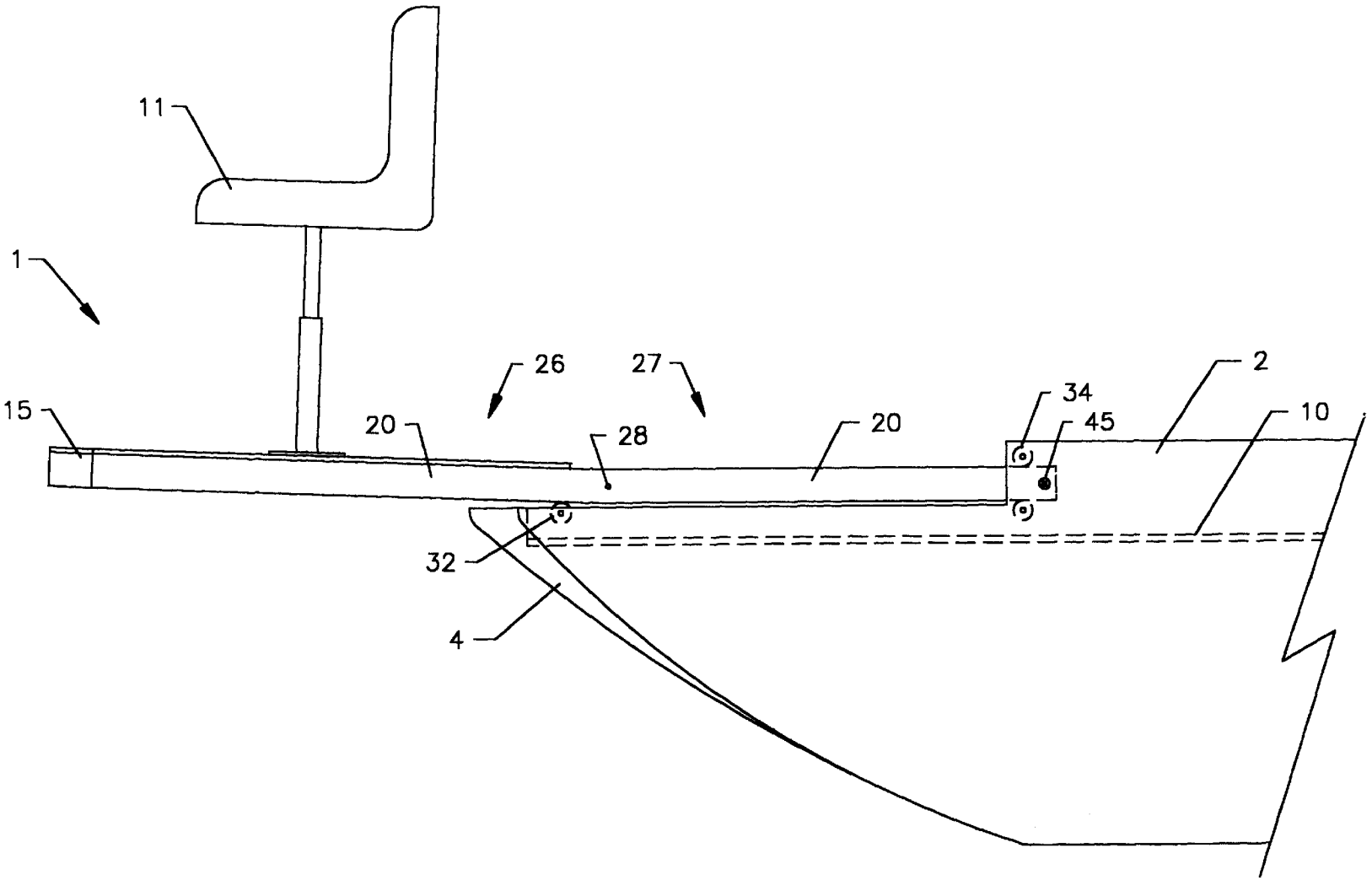
FIG. 9 is a side elevation view of FIG. 8, shown with the deck in the extended position.
Figure 10:
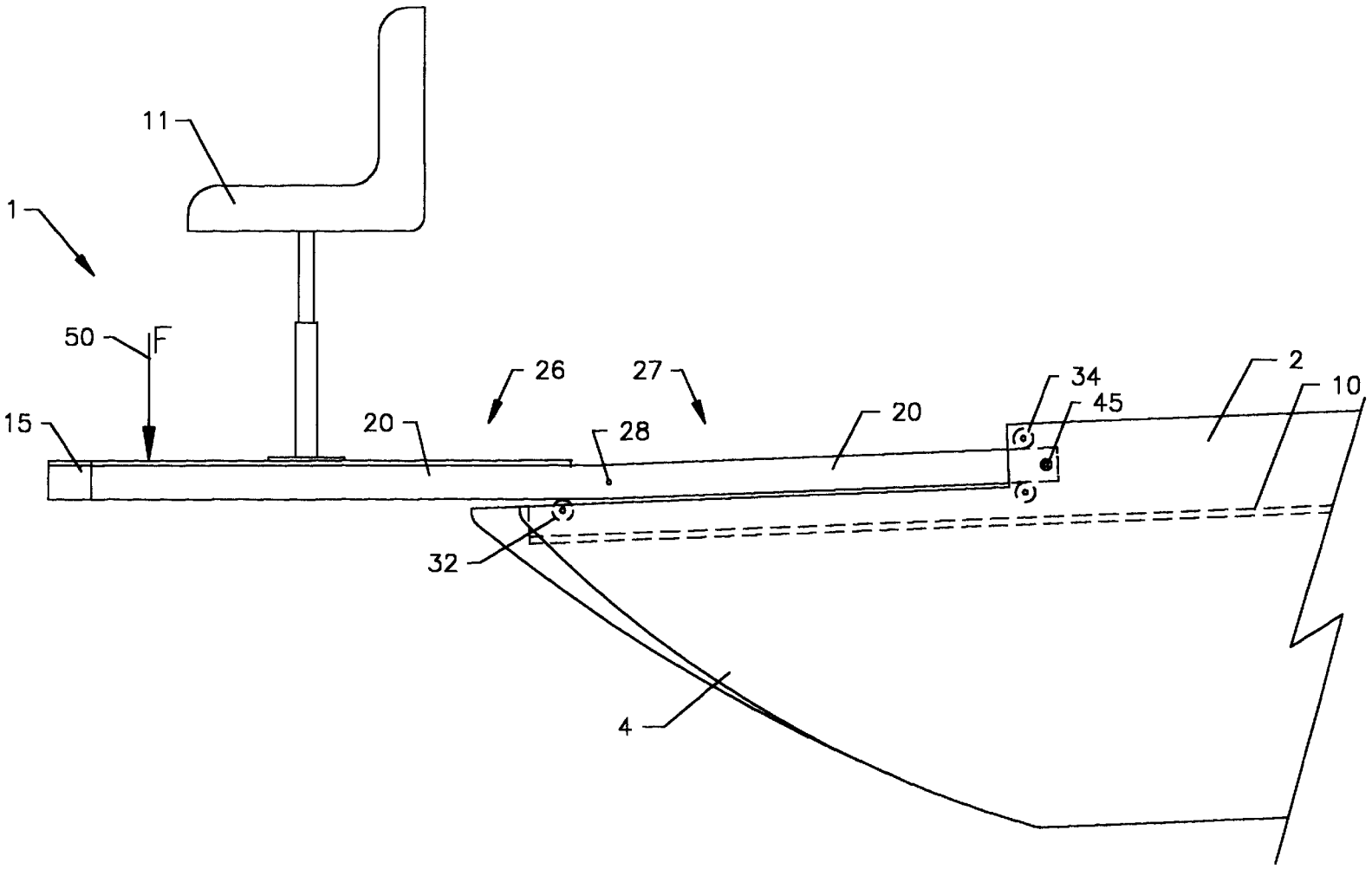
FIG. 10 is a side elevation view of FIG. 9, shown with the deck in the extended position and loaded

Referring to FIGS. 8 through 10, the extendable deck assembly 1 is provided with the outer guide rails 19, 20 formed such that the back portion 27 is slanted slightly upward relative to the front portion 26, as seen in FIG. 8. This option should be used on boats which significantly tilt forward due to the overhung load caused by the extendable deck 15. The extendable deck 15 is level relative to the boat 2 when the extendable deck 15 is in the retracted position. When the extendable deck 15 is in the extended position, the extendable deck 15 is slanted slightly upward relative to the boat 2, as seen in FIG. 9. When a load 50 is placed on the extendable deck 15 in the extended position, the boat 2 may tilt forward due to the overhung load. This will cause the extendable deck 15 to level relative to the water, thereby compensating for the tilting of the boat 2, as seen in FIG. 10.

Figure 11:
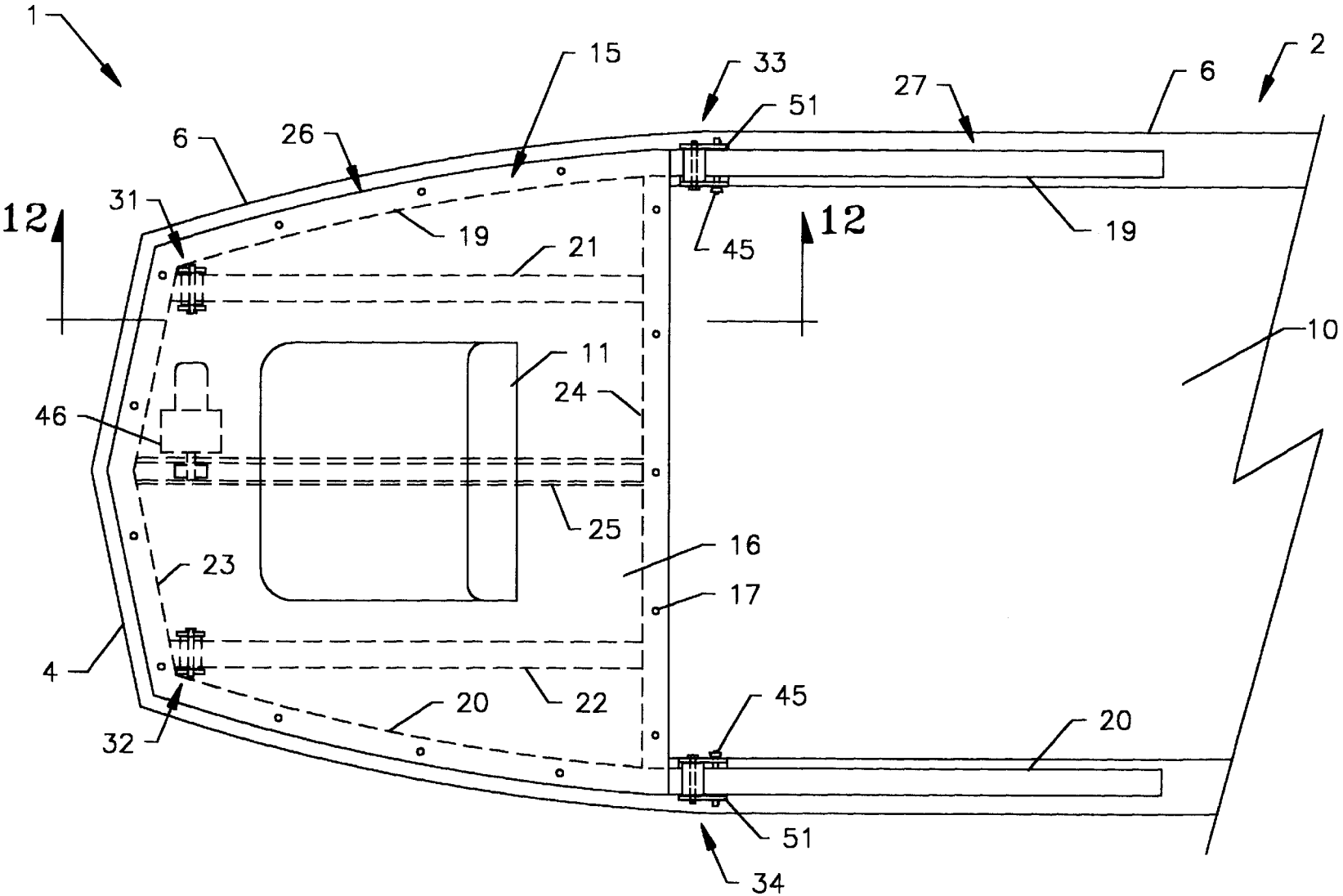
FIG. 11 is a plan view of a boat adapted with an extendable deck assembly mounted with bracket assemblies, shown with the deck in the retracted position.
Figure 12:
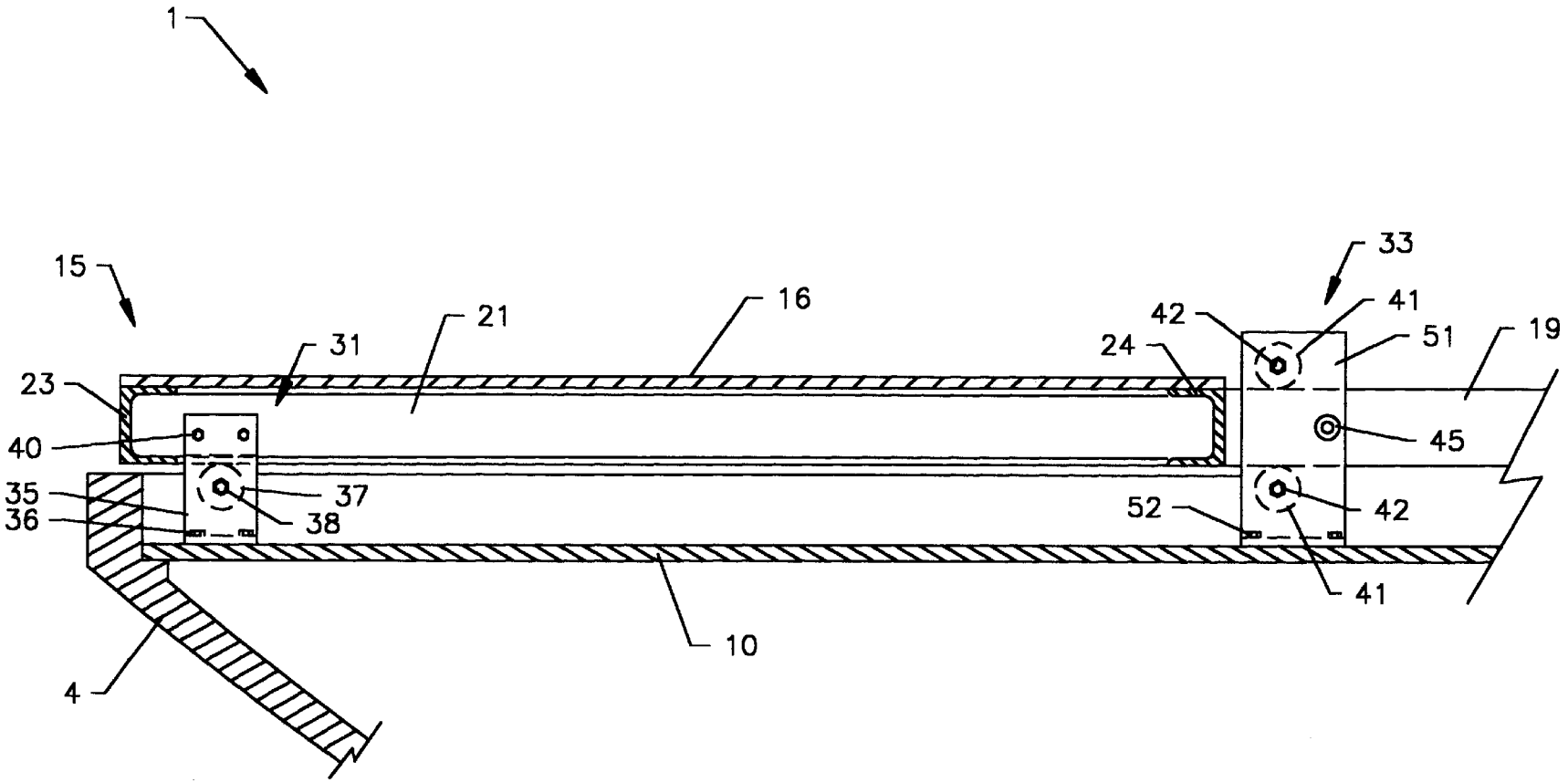
FIG. 12 is a horizontal section view taken along line 12—12 of FIG. 11.

Referring to FIGS. 11 and 12, the extendable deck assembly 1 is provided with back guide roller mounting brackets 51 for installation on existing boats as an add-on feature rather than a built-in feature. The extendable deck assembly 1 is identical to that discussed above excepting that the back guide roller assemblies 33, 34 are mounted in guide roller brackets 51 in lieu of the boat sidewall cavities 7. The guide roller brackets 51 are constructed of sheet metal and are secured to the stationary deck 10 of the boat 2 with mounting bolts 52, as shown. Clamp-on type mounting brackets may also be provided for certain boats as is obvious to anyone skilled in the art.

Figure 13:
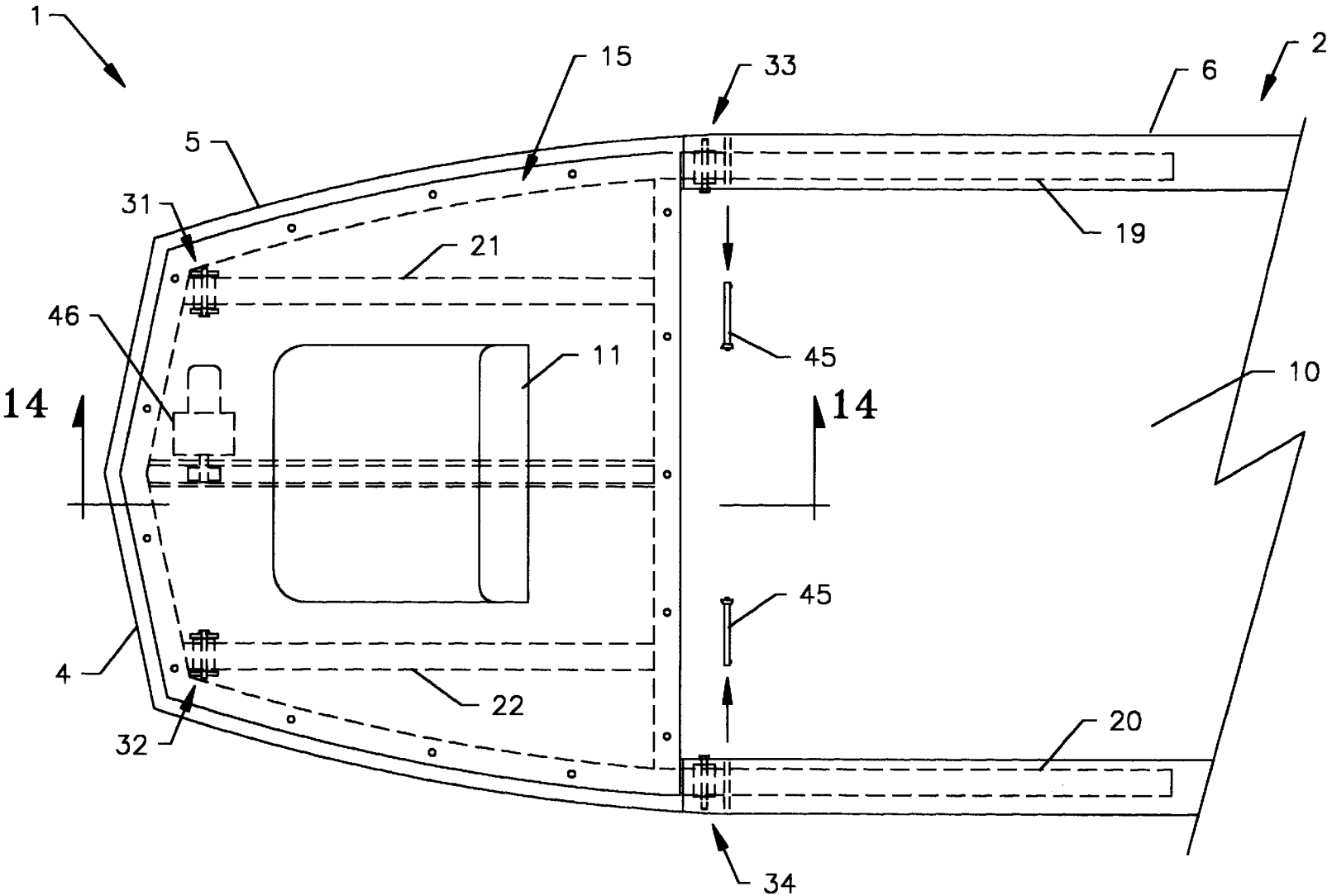
FIG. 13 is a plan view of FIG. 2 shown with the quick pins removed and the extendable deck ready for extension.
Figure 14:
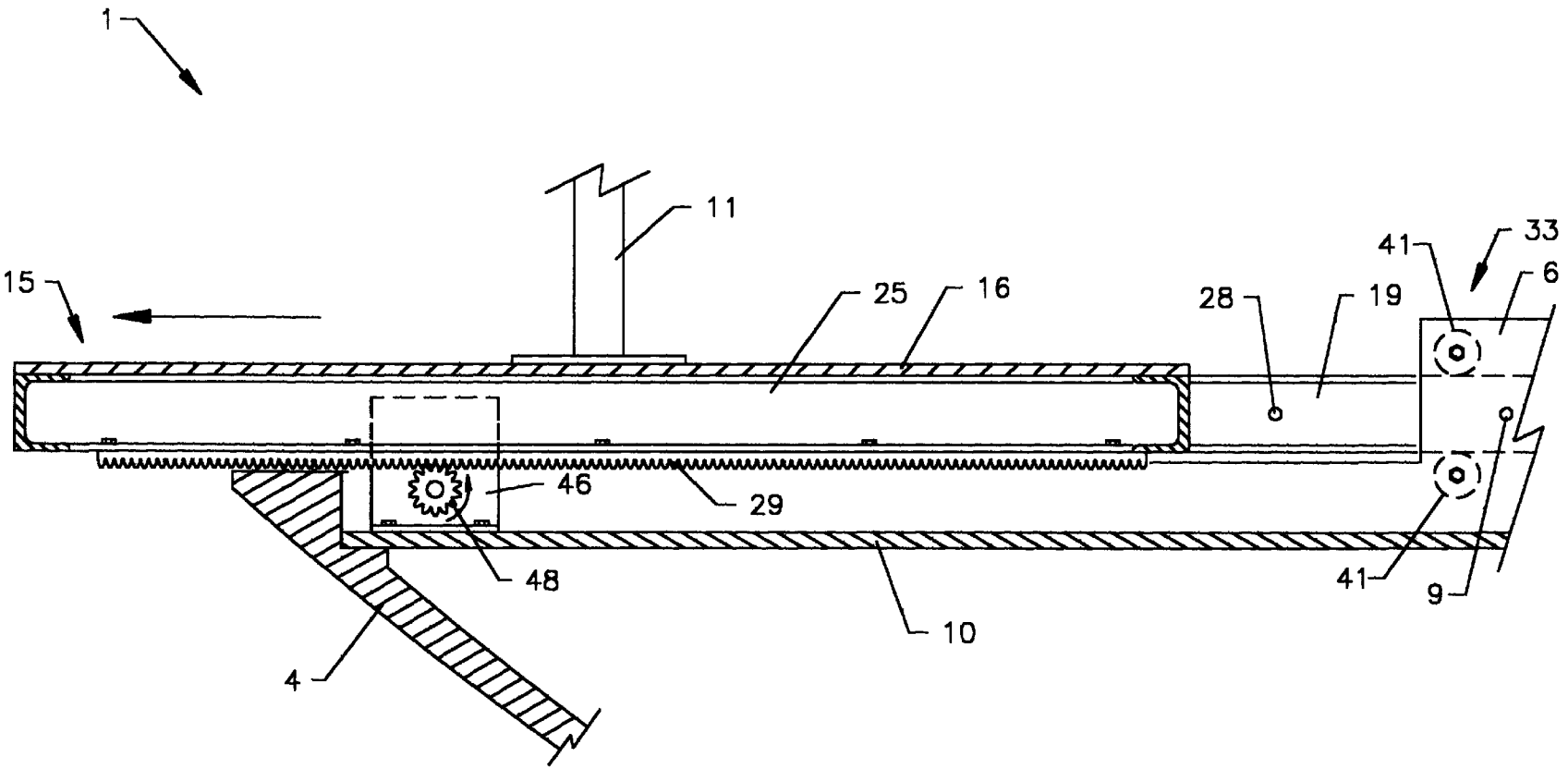
FIG. 14 is a horizontal section view taken along line 14—14 of FIG. 13 shown with the extendable deck in forward motion.
Figure 15:
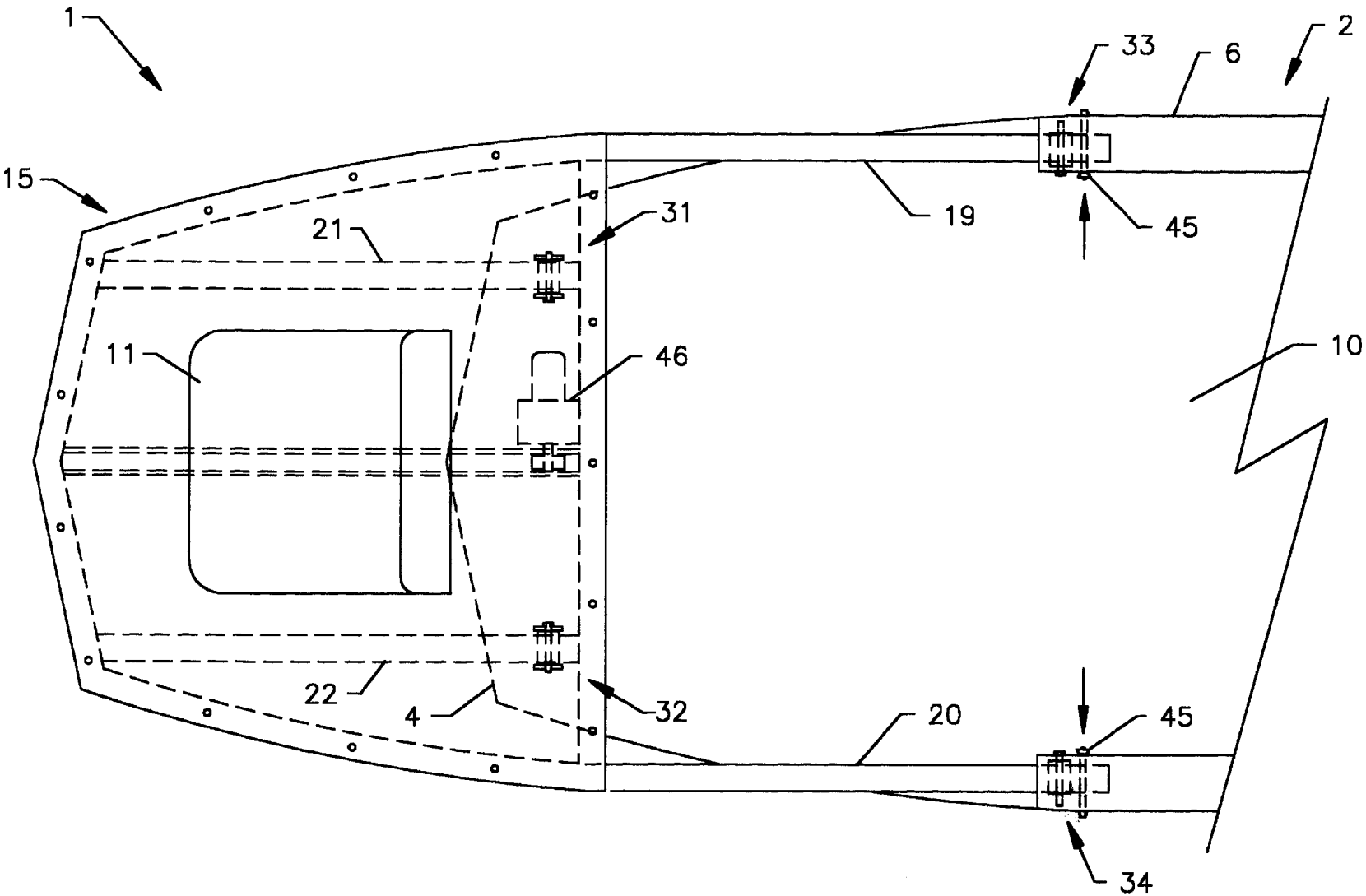
FIG. 15 is a plan view of the extendable deck assembly shown in the extended position with the quick pins inserted.
Figure 16:
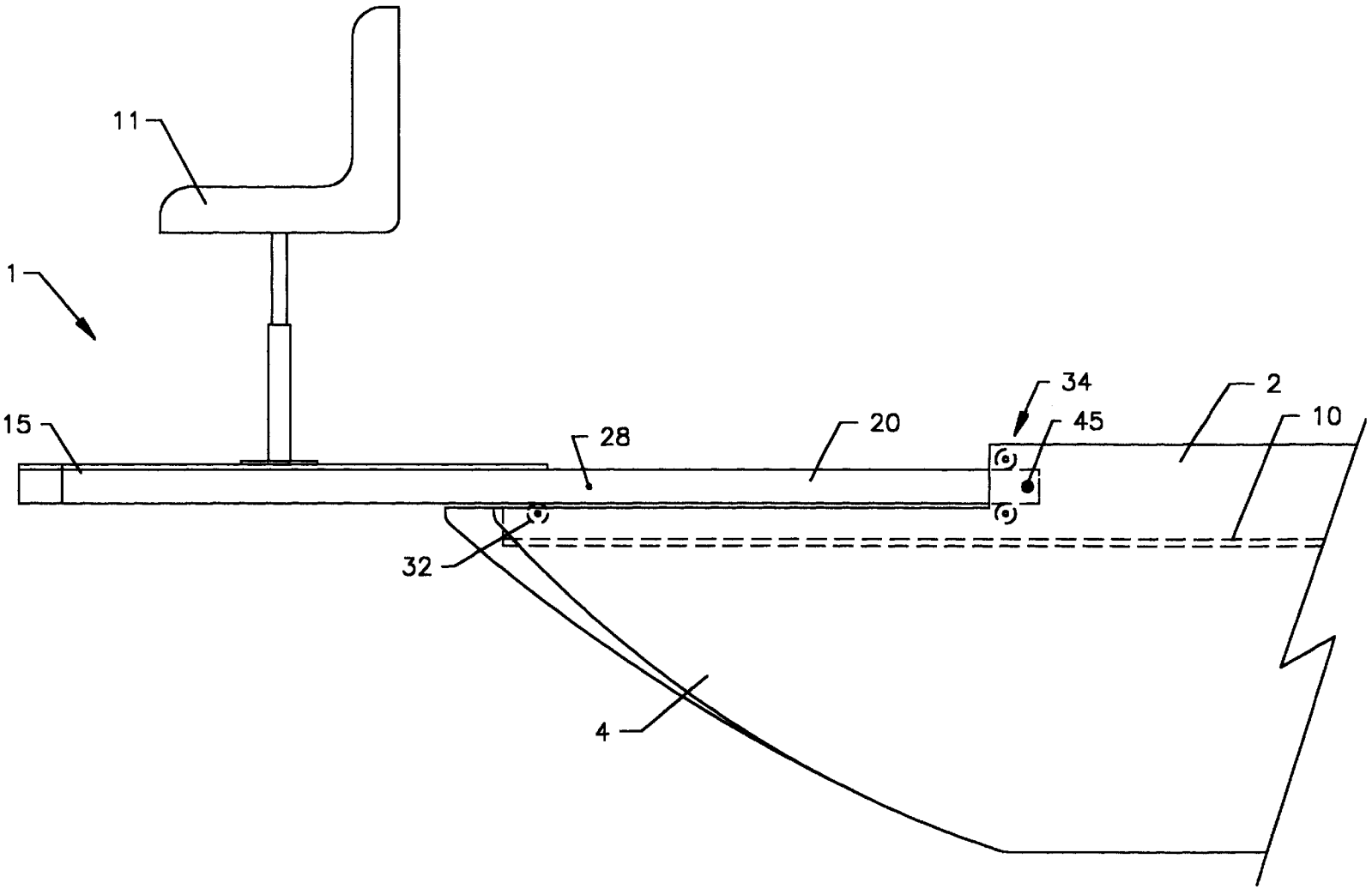
FIG. 16 is a side elevation view of FIG. 15.

In operation, the present invention is illustrated in FIGS. 13 through 16. Referring to FIG. 13, the extendable deck 15 is extended by first removing the quick pins 45 from the boat sidewall cavities 7. The extendable deck 15 is then moved longitudinal forward by means of the gearmotor 46 which rotates the pinion gear 48, as seen in FIG. 14. When the extendable deck 15 is in the fully extended position, the quick pins 45 are inserted back into the boat sidewall cavities 7, as seen in FIG. 15, thereby retaining the extendable deck 15 in the extended position, as seen in FIG. 16. The extendable deck 15 may be returned to the retracted position by simply reversing the above procedure.

The extendable deck assembly 1 may be operated by any common electrical circuit easily constructed by anyone skilled in the art. A limit switch may also be employed to prevent operation of the outboard motor 3 unless the extendable deck 15 is in the fully retracted position, as seen in FIG. 1. The extendable deck assembly 1 may be actuated by various methods including hydraulic cylinders, ball screw actuators, and by powering the guide rollers, as will be obvious to anyone skilled in the art. The extendable deck assembly 1 may also be provided for manual operation in which case the gearmotor 46, pinion gear 48, and gear rack 29 are omitted.

The present invention may be provided in other modified forms without departing from the spirit and scope of the invention. The foregoing description is provided to illustrate one embodiment of the invention for purposes of this disclosure and it is intended to cover all changes and modifications which do not depart from the spirit and scope of this invention.

What is claimed is:

1. An extendable deck assembly for a boat having a longitudinal axis extending from a bow of the boat to a stern of the boat; said extendable deck assembly providing an extendable deck portion, said extendable deck portion being extendable and retractable from said boat in a longitudinal manner, said extendable deck portion creating additional use area of said boat in the extended position;

said extendable deck portion being extended and retracted in a longitudinal manner by means of guide rails attached to said extendable deck portion, said guide rails interfacing with at least one front and at least two back guide roller assemblies; said guide roller assemblies guiding the extendable deck in a longitudinal manner;

said guide rails comprising at least one inner guide rail and at least two outer guide rails; with said front guide roller assembly interfacing with said inner guide rail and each of said back guide roller assemblies interfacing with one outer guide rail.

2. The extendable deck assembly of claim 1 wherein said outer guide rails each have a front portion and a back portion, said front portions being formed to match a peripheral curvature of the boat and said back portions remaining straight and parallel to one another.

3. The extendable deck assembly of claim 1 wherein said outer guide rails each have a front portion and a back portion said outer guide rails being formed such that said back portions are slanted upward relative to said front portions.

4. An extendable deck assembly for a boat, said boat including a stationary deck located between a bow of the boat and a stern of the boat defining a use area for occupants of said boat and having a longitudinal axis extending from the bow of the boat to the stern of the boat; said extendable deck assembly being mounted to said boat, and including an extendable deck that is movable in a plane substantially parallel to the stationary deck between an extended position and a retracted position, at least a portion of said extendable deck being positioned over at least a portion of the stationary deck when the extendable deck is in the retracted position, at least a portion of said extendable deck extending outwardly from the bow of said boat in a longitudinal direction and in a cantilevered position when the extendable deck is in the extended position.

5. The extendable deck assembly as set forth in claim 4 further including means for permitting movement of said extendable deck between the extended position and the retracted position.

6. The extendable deck assembly as set forth in claim 5 wherein said means for permitting movement of said extendable deck includes at least one guide roller rotatably mounted to said boat, and at least one guide rail mounted to said extendable deck, said guide rail being adapted to accommodate said guide roller to permit movement of said extendable deck between the extended position and the retracted position.

7. The extendable deck assembly as set forth in claim 6 farther including at least one guide block attached to the boat to prevent sideward movement of said extendable deck relative to the longitudinal axis of the boat.

8. The extendable deck assembly as set forth in claim 6 including at least one front guide roller and at least two back guide rollers, and further including at least one inner guide rail and at least two outer guide rails, said front guide roller interfacing with said inner guide rail and each said back guide roller interfacing with one outer guide rail.

9. The extendable deck assembly as set forth in claim 8 wherein said outer guide rails provide a front portion and a back portion, said front portions being formed to match a peripheral curvature of the boat and said back portions remaining substantially straight and parallel to one another.

10. The extendable deck assembly as set forth in claim 6 wherein said guide rail includes a front portion mounted to said extendable deck, and a back portion extending rearwardly and outwardly from said extendable deck.

11. The extendable deck assembly as set forth in claim 10 wherein said back portion of said guide rail is bent upwardly at an acute angle with respect to a plane in which the front portion of said guide rail lies.

12. The extendable deck assembly as set forth in claim 10 wherein said back portion and said front portion of said guide rail are substantially coplanar.

13. The extendable deck assembly as set forth in claim 4 further including an actuating device that is selectively energized to move the extendable deck inwardly over the stationary deck into the retracted position, or outwardly from the bow of the boat into the extended position.

14. The extendable deck assembly as set forth in claim 13 wherein said actuating device includes a gearmotor having an output shaft with a pinion gear mounted thereon, and a gear rack mounted to the extendable deck and adapted to engage the pinion gear of the gearmotor, said extendable deck being moved between the extended and acted positions based upon the direction of rotation of the pinion gear.

15. An extendable deck assembly for a boat having a longitudinal axis extending from a bow of the boat to a stern of the boat comprising:

a deck providing a use area for occupants of the boat, said deck being movable between a retracted position in which at least a portion of said deck is positioned over at least a portion of the bow of the boat, and an extended position in which at least a portion of said deck extends outwardly from the bow of the boat in a longitudinal direction and in a cantilevered position; at least one guide roller rotatably mounted to said boat; and at least one guide rail mounted to said deck, said guide rail being adapted to accommodate said guide roller to permit movement of said deck.

16. An extendable deck assembly for a boat having a longitudinal axis extending from a bow of the boat to a stern of the boat comprising:

a deck providing a use area for occupants of the boat, said deck being movable between a retracted position in which at least a portion of said deck is positioned over at least a portion of the bow of the boat, and an extended position in which at least a portion of said deck extends outwardly from the bow of the boat in a longitudinal direction and in a cantilevered position; and an actuating device that is selectively energized to move the deck inwardly over the bow into the retracted position, and outwardly from said bow into the extended position.

17. An extendable deck assembly for a boat having a longitudinal axis extending between a bow and a stern, comprising;

a deck providing an area for use by occupants of the boat;

at least one guide roller rotatably mounted to the boat; and at least one guide rail mounted to said deck, said guide rail being adapted to accommodate said guide roller to permit movement of said deck between a retracted position in which at least a portion of said deck is positioned over at least a portion of the boat, and an extended position in which at least a portion of said deck extends outwardly from the bow of the boat, said deck being usable by the occupants in the extended position and the retracted positions.

18. The extendable deck assembly as set forth in claim 17 further including at least one guide block attached to said boat to prevent sideward movement of said deck relative to said boat.

19. The extendable deck assembly as set forth in claim 17 further including an actuating device for moving said deck between the extended position and the retracted position.

20. The extendable deck assembly as set forth in claim 19 wherein said actuating device includes a gearmotor having an output shaft with a pinion gear mounted thereon, and a gear rack mounted to the deck that is adapted to engage the pinion gear of the gearmotor, said deck being moved between the extended and retracted positions based upon the direction of rotation of the pinion gear.

21. The extendable deck assembly as set forth in claim 17 wherein said guide rail includes a front portion mounted to said deck, and a back portion extending rearwardly and outwardly from said deck.

22. The extendable deck assembly as set forth in claim 21 wherein said back portion of said guide rail is bent upwardly at an acute angle with respect to a plane in which the front portion of said guide rail lies.

23. The extendable deck assembly as set forth in claim 21 wherein said back portion and said front portion of said guide rail are substantially coplanar.

24. The extendable deck assembly as set forth in claim 17 including at least one front guide roller and at least two back guide rollers, and further including at least one inner guide rail and at least two outer guide rails, said front guide roller interfacing with said inner guide rail and each said back guide roller interfacing with one outer guide rail.

25. The extendable deck assembly as set forth in claim 24 wherein said outer guide rails provide a front portion and a back portion, said front portions being formed to match a peripheral curvature of the boat and said back portions remaining substantially straight and parallel to one another.

26. An extendable deck assembly for a boat, said boat having a longitudinal axis extending from a bow of the boat to a sternof the boat, said deck assembly being connectable to said boat, and including an extendable deck, said extendable deck being movable between an extended position and a retracted position in a substantially longitudinal manner, at least a portion of said deck being positioned over at least a portion of said boat when the deck is in the retracted position, at least a portion of said extendable deck extending outwardly from the bow of the boat when the extendable deck is in the extended position; said deck assembly further including an actuating device that is selectively energized to move the extendable deck inwardly over the boat into the retracted position, or outwardly away from said boat into the extended position, said actuating device including a gearmotor having an output shaft with a pinion gear mounted thereon, and a gear rack mounted to the extendable deck and adapted to engage the pinion gear of the gearmotor, said extendable deck being moved between the extended and retracted positions based upon the direction of rotation of the pinion gear.

* * * * *